US009441489B2

(12) United States Patent
Saxer et al.

(10) Patent No.: US 9,441,489 B2
(45) Date of Patent: Sep. 13, 2016

(54) SEALING STRUCTURE ON A SHROUD OF A TURBINE BLADE

(75) Inventors: Andre Saxer, Mellingen (CH); Igor Tsypkaykine, Turgi (CH); Ulrich Rathmann, Baden (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 1113 days.

(21) Appl. No.: 13/076,653

(22) Filed: Mar. 31, 2011

(65) Prior Publication Data

US 2011/0243714 A1 Oct. 6, 2011

(30) Foreign Application Priority Data

Mar. 31, 2010 (CH) ..... 476/10

(51) Int. Cl.

| | |
|---|---|
| ***F01D 11/08*** | (2006.01) |
| ***F01D 5/22*** | (2006.01) |
| ***F01D 5/20*** | (2006.01) |
| ***F01D 5/26*** | (2006.01) |
| ***F01D 11/12*** | (2006.01) |

(52) U.S. Cl.

CPC ..... *F01D 5/225* (2013.01); *F01D 5/20* (2013.01); *F01D 5/26* (2013.01); *F01D 11/125* (2013.01); *F05D 2250/70* (2013.01)

(58) Field of Classification Search

CPC ..... F01D 5/20; F01D 5/225; F01D 5/26; F01D 11/125; F05D 2250/70

USPC ..... 415/173.6, 174.6; 416/189, 241 B, 195

See application file for complete search history.

(56) References Cited

U.S. PATENT DOCUMENTS

| | | | | |
|---|---|---|---|---|
| 5,355,637 | A * | 10/1994 | Wiltshire et al. | 51/295 |
| 6,857,853 | B1 * | 2/2005 | Tomberg et al. | 416/192 |
| 7,066,713 | B2 * | 6/2006 | Dube et al. | 415/173.5 |
| 2004/0208743 | A1 * | 10/2004 | Urban | 415/173.4 |
| 2005/0036886 | A1 * | 2/2005 | Tomberg | 415/173.4 |
| 2005/0129519 | A1 | 6/2005 | Beddard et al. | |
| 2005/0191182 | A1 | 9/2005 | Seleski | |
| 2009/0123268 | A1 * | 5/2009 | Brittingham et al. | 415/115 |
| 2009/0263248 | A1 | 10/2009 | Brittingham | |

FOREIGN PATENT DOCUMENTS

| | | |
|---|---|---|
| DE | 19904229 | 8/2000 |
| DE | 102008023424 | 11/2008 |
| DE | 102008044419 | 2/2009 |
| DE | 102008037521 | 5/2009 |
| EP | 1507064 | 2/2005 |
| EP | 1507066 | 2/2005 |

OTHER PUBLICATIONS

Search Report for Swiss Patent App. No. 00476/2010 (Aug. 6, 2010).

* cited by examiner

*Primary Examiner* — Dwayne J White
*Assistant Examiner* — Kayla McCaffrey
(74) *Attorney, Agent, or Firm* — Buchanan Ingersoll & Rooney PC

(57) ABSTRACT

A device on a shroud which is provided on a turbine rotor blade tip has a cutting structure designed like a line of ribs, locally projecting over the shroud radially to the rotational axis around which the turbine rotor blade is rotatably arranged. The sealing structure has a longitudinal extent (S) oriented in the direction of rotation (U) of the turbine rotor blade, tapers with increasing radial distance from the shroud, and terminates with a flat end face (St) which radially faces away from the turbine rotor blade, and can be divided into five interrelated surfaces.

18 Claims, 2 Drawing Sheets

SEALING STRUCTURE ON A SHROUD OF A TURBINE BLADE

This application claims priority under 35 U.S.C. §119 to Swiss App. No. 00476/10, filed 31 Mar. 2010, the entirety of which is incorporated by reference herein.

BACKGROUND

1. Field of Endeavor

The invention relates to a device on a shroud, which is provided on a turbine rotor blade tip, with a sealing structure designed like a line of ribs, locally projecting over the shroud radially to the rotational axis around which the turbine rotor blade rotates, which sealing structure has a longitudinal extent oriented in the circumferential direction of the turbine rotor blade, tapers with increasing radial distance from the shroud and has an end face which is formed flat and radially faces away from the turbine rotor blade.

2. Brief Description of the Related Art

Turbine rotor blades in most cases are provided with a shroud on their turbine rotor blade tips, which develops a vibration-reducing effect upon the respective turbine rotor blade airfoil and therefore promotes extension of the service life of the turbine rotor blade. Moreover, provision is made on each of the shrouds for at least one sealing structure of rib-like design which, on the end-face side, radially projects over the end-face shroud surface in relation to the rotational axis and extends along the shroud in the rotational direction in relation to the rotational movement of the turbine rotor blades.

Such sealing structures above all serve for reducing leakage flows which develop along the flow passage between the turbine rotor blade tips and the stationary turbine casing and which do not contribute to the power gain of the turbine. These sealing structures are based on abrasive materials and, as a result of rotation of the turbine rotor blades and on account of their radial prominence in relation to the shrouds, make it possible for an abradable wall structure, lying radially opposite the turbine rotor blade tips on the turbine casing and typically designed in the manner of a honeycomb structure, to be ground into, forming a circumferentially extending groove-like recess in such a way that the end-face shroud surface certainly includes a minimum gap with the wall structure, but the rib-like sealing element projects almost in an accurately fitting manner into the groove-like recess which is automatically cut out by the seal element. In axial projection, therefore, each rotor blade tip, with its sealing structure which engages in the groove-like recess, terminates in a largely gas-tight manner for a gaseous operating medium which flows axially through the turbine.

Vibration trials carried out on turbine rotor blades, however, showed that an almost total prevention of any leakage flows leads to strongly pronounced vibration instabilities along the rotating turbine rotor blade airfoils.

Such vibrations can be significantly reduced, however, if a leakage flow can develop between the turbine rotor blade tips and the turbine casing.

Therefore, it is necessary, in accordance with a ratio, which is as balanced as possible, between both phenomena which are in competition with each other, to seek to minimize the loss-affected leakage flows on the one hand and the occurrence of structure-weakening vibrations on the other hand.

For this, on the rib-like sealing structure which projects radially over the shroud and in the longitudinal extent typically has a largely constant cross-sectional shape, provision is made for a cutting structure which locally increases the cross-sectional shape axially, that is to say transversely, to the direction of rotation, and which on the two axially oppositely disposed flanks has cutting surfaces facing the sealing structure in the direction of rotation. The cutting surfaces, which project locally from the sealing structure, enable a wider dimensioned groove-like recess to be impressed, in comparison to the remaining axial sealing structure width, inside the abradable turbine casing wall which in most cases is formed as a honeycomb structure, so that the sealing structure is not able to lie in an accurately fitting manner over its entire longitudinal extent in the groove-like recess and therefore a leakage flow, which can be proportionally established, can develop as a result of the ensuing gap between sealing structure and groove-like recess.

It should be added that the rib-like sealing structure, which is provided on the shroud, in most cases does not coincide with the radial center of gravity plane of the turbine rotor blade in the radial direction along the turbine rotor blade, as a result of which additional load moments occur, especially at high speeds and high process temperatures, which can lead to increased creep rates and ultimately to material failure in the connecting region between the shroud and the turbine rotor blade airfoil.

For combating this load problem, it has been proposed in EP 1 507 066 A2 to arrange the cutting structures, which are provided on the rib-like sealing structure, largely centrally to the longitudinal axis of the rib-like sealing structure, wherein the cutting structure should lie as close as possible to the radial center of gravity position of the turbine rotor blade. In FIG. 6 of the printed version of EP 1 507 066 A2, a radial plan view of the rib-like sealing structure relative to the shroud is shown, which sealing structure has a V-shaped taper in cross section, with increasing radial distance to the shroud, and on the side flanks which face each other in each case has a cutting surface which is raised beyond the respective side flank, which cutting surfaces in longitudinal extent occupy different mutually offset positions in relation to the rib-like structure. The combination which can be gathered from EP 1 507 066 A2 and consists of a rib-like sealing structure which radially projects over the shroud of a turbine rotor blade, and a cutting structure which is attached to the sealing structure and located as close as possible in the region of the radial center of gravity line of the turbine rotor blade, enables the operation-induced vibration behavior and the material loads associated therewith, especially in the region of the rotor blade tip, to be positively influenced only in the case of turbine rotor blades up to a specific maximum size. If, however, the necessity should be for turbine rotor blades which are longer and therefore of larger construction, the shrouds of which assume a considerable length dimension oriented in the direction of rotation, virtually corresponding to that of the rib-like sealing structure which is oriented in the direction of rotation and spans the shroud similar to a bridge or an arch, then substantial bending loads occur in the radial direction, leading to high mechanical loads in the shroud region. In order to withstand these undesirably high bending loads, it would make sense in any event to enlarge the rib-like sealing structure according to EP 1 507 066 A2, that is to say to increase the height and width. Such a measure, however, leads to a significant mass increase and also to deterioration of the grind-in properties of the cutting contours which are provided along the rib-like sealing structure.

SUMMARY

One of numerous aspects of the present invention includes alleviating the aforementioned problem when creating turbine rotor blades of large dimensions and of optimizing the region of the shroud with a sealing structure which is provided thereupon, both with regard to its loadability and with regard to a mass reduction, including reducing operation-induced mechanical loads and stresses which occur in the turbine rotor blade tip region and as a result the turbine rotor blade service life can ultimately be significantly increased.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
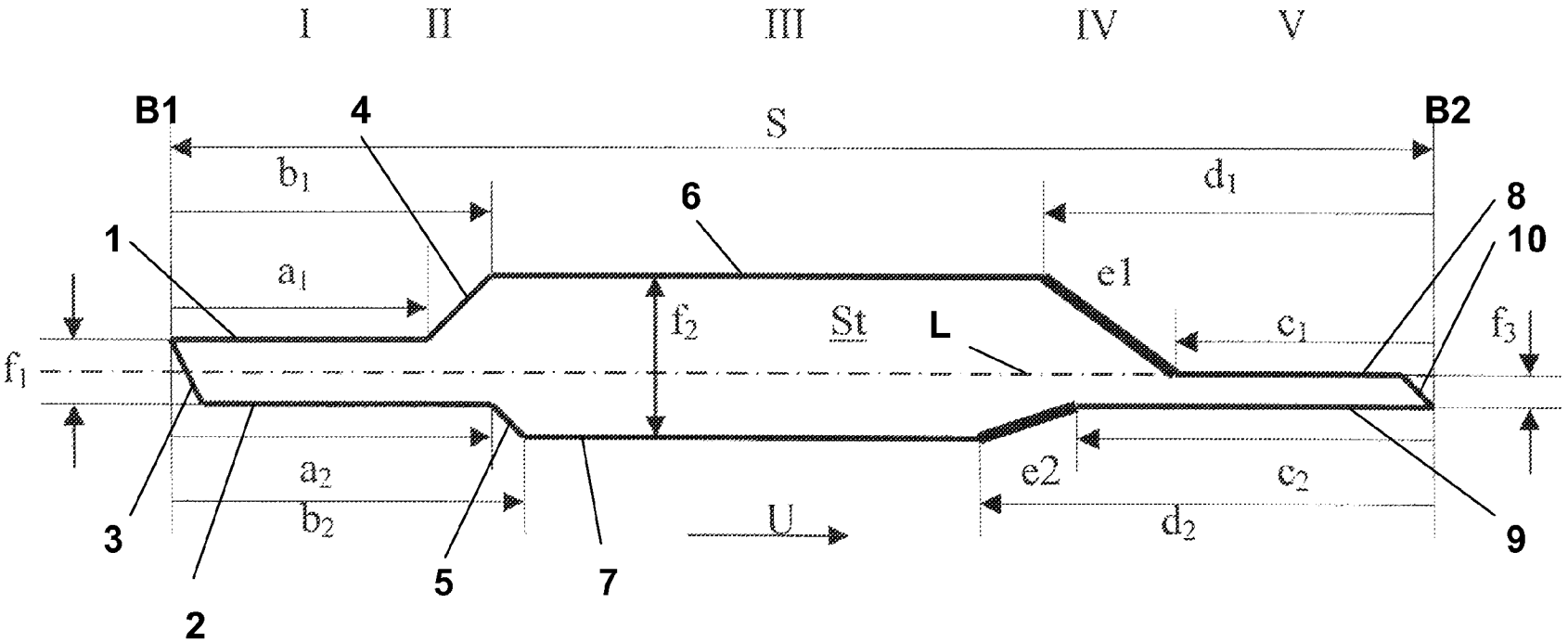
FIG. 1 illustrates a radial plan view of an exemplary sealing structure.

In general terms, a sealing structure embodying principles of the present invention is designed like a line of ribs, locally projecting over the shroud of a turbine rotor blade tip in the radial direction relative to the rotational axis around which the turbine rotor blade is rotatably arranged, has a longitudinal length or extent (S) oriented in the direction of rotation (U) of the turbine rotor blade, and conically tapers with increasing radial distance from the shroud. The sealing structure has a flat formed end face St which radially faces away from the turbine rotor blade and has a base surface shape which is illustrated in FIG. 1 and in the direction of rotation U is divided into five interrelated surface sections I to V which, in the following way, extend along a longitudinal axis L oriented in the direction of rotation U.

A first surface section I is delimited by two side edges 1, 2 extending parallel to the longitudinal axis, which have a mutual spacing f1 and of which the first side edge 1 extends to a distance a1 and the second side edge 2 extends to a distance a2, measured from a first reference plane B1 which orthogonally intersects the longitudinal axis L and delimits the end face St at the rear end in the direction of rotation U, wherein the second side edge 2 is at a distance from the first reference plane B1 and is connected to the first side edge 1 via a rear delimiting edge 3 which is oriented in an inclined manner in relation to the longitudinal axis L.

A second surface section II is delimited by two side edges 4, 5 extending in an inclined manner in relation to the longitudinal axis L, of which the first side edge 4 extends from the distance a1 to the distance b1 and the second side edge 5 extends from the distance a2 to the distance b2, measured in each case from the first reference plane B1.

A third surface section III is delimited by two side edges 6, 7 extending parallel to the longitudinal axis L, which have a mutual spacing f2 and of which the first side edge 6 is connected to the first side edge 4 of the second surface section II and the second side edge 7 is connected to the second side edge 5 of the second surface section II.

A fourth surface section IV is delimited by two side edges e1, e2, the so-called cutting edges, extending in an inclined manner in relation to the longitudinal axis L, of which the first cutting edge e1 extends from the distance d1 to the distance c1 and the second cutting edge e2 extends from the distance d2 to the distance c2, measured in each case from a second reference plane B2 which orthogonally intersects the longitudinal axis L and delimits the end face St at the front end in the direction of rotation U.

A fifth surface section V is delimited by two side edges 8, 9 extending parallel to the longitudinal axis L, which have a mutual spacing f3 and of which the first side edge 8 extends to a distance c1 and the second side edge 9 extends to a distance c2, measured from the second reference plane B2, wherein the first side edge 8 is at a distance from the second reference plane B2 and is connected to the first side edge 9 via a front delimiting edge 10 which is oriented in an inclined manner in relation to the longitudinal axis L.

According to a preferred embodiment, the following applies to geometry parameters S, a1, a2, b1, b2, c1, c2, d1, d2, f1, f2, f3:

$S = 45$ mm to 200 mm $a1 < a2$ and $\frac{1}{16} S \leq (a1, a2) \leq \frac{1}{2} S$ $b1 < b2$ and $\frac{1}{16} S \leq (b1, b2) \leq \frac{1}{2} S$ $c1 < c2$ and $\frac{1}{16} S \leq (c1, c2) \leq \frac{1}{2} S$ $d1 < d2$ and $\frac{1}{16} S \leq (d1, d2) \leq \frac{1}{2} S$ $f3 < f1$ and $\frac{1}{62} S \leq (f1, f3) \leq \frac{1}{14} S$ $\frac{1}{42} S \leq f2 \leq \frac{1}{5} S$.

According to an exemplary embodiment, it can be shown that with such a rib-like sealing structure, the radially end-side end face St, of which has the surface geometry which is illustrated in FIG. 1, two positive effects are achieved, specifically an improved stiffening of the rib-like sealing structure in the direction of rotation U on the one hand, and an improved cutting action of the rib-like sealing structure in the abradable turbine casing wall material on the other hand. The first-named effect leads to a significantly higher mechanical loadability of the sealing structure which ultimately arises from an axial widening of the sealing structure which is provided centrally along the longitudinal length of the rib-like sealing structure. In this central region, the sealing structure has an axial width f2, to which applies: $\frac{1}{42} S \leq f2 \leq \frac{1}{5} S$. The axial width of the sealing structure before this central widening in the direction of rotation, however, measures only $\frac{1}{62} S \leq f3 \leq \frac{1}{14} S$. The improved cutting action, however, arises from the cutting edges e1 and e2 facing in the direction of rotation, which serve as transition regions between the rib region, of narrow design in the axial extent, in the fifth surface section with a web width f3, and the third surface section, of axially considerably wider design, with an axial rib width f2.

At least the cutting edges e1, e2 are advantageously coated with a surface-hardened coating, such as $Cr_2C$ or CBN (cubically crystalline boron nitride). The coating process is preferably carried out by way of galvanic deposition, plasma deposition, spray deposition or by way of a welding or soldering process.

Figure 2:
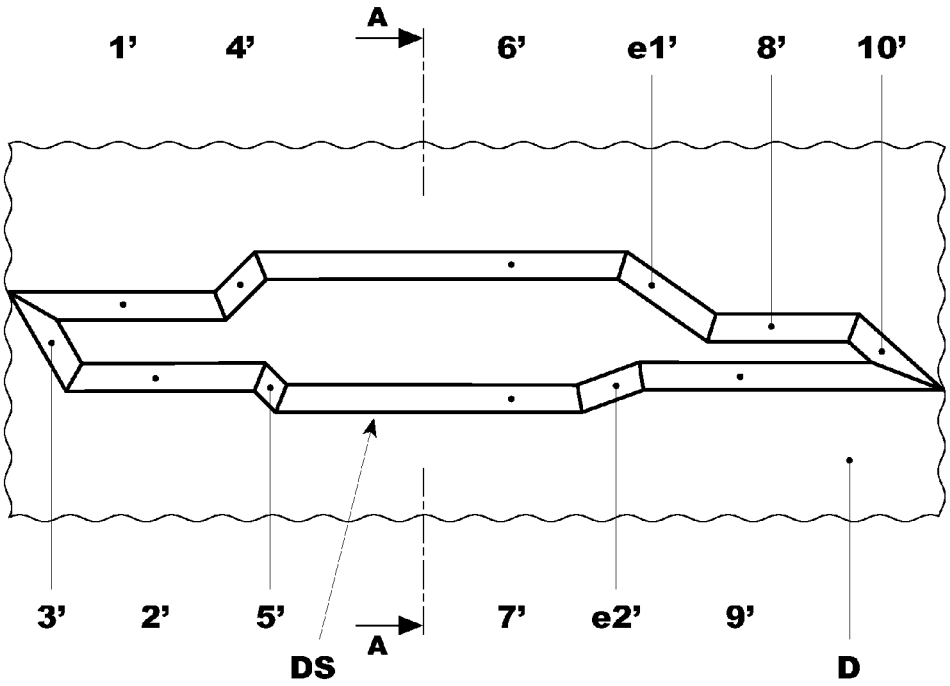
FIG. 2 illustrates a perspective view of a shroud of a turbine rotor blade.

Shown in FIG. 2, for qualitative illustration of the sealing structure which is designed according to principles of the present invention, is a perspective view of the shroud D of a turbine rotor blade, which is not additionally illustrated.

The sealing structure DS is preferably connected in one piece to the shroud D and is raised above the shroud D with side flanks 1' to 10' which correspond in each case to the side edges 1 to 10 which delimit the end face St. In this context, it should be noted that the cutting edge surfaces e1' and e2', which are assigned to the cutting edges e1 and e2, are provided with the surface-hardened coating 11 for improving the cutting action. By the same token, the cutting surface 10' can advantageously be provided with a corresponding surface-hardened coating 11. However, all the side edge surfaces in an especially advantageous way can be provided with a corresponding coating, the end face St also being especially so provided with the surface-hardened coating.

The sealing structure DS, which can be gathered from FIGS. 1 and 2, in an advantageous embodiment has a longitudinal extent S which corresponds to the shroud length which is oriented in the direction of rotation U. Depending upon the shape and size of the shroud, a plurality of sealing structures DS can be arranged on the surface of a shroud D, preferably so in a spaced apart manner next to each other in the direction of rotation.

In an advantageous way, the side edges 1, 4, 6, e1 and 8 are oriented to face the suction side of the turbine rotor blade airfoil and the side edges 2, 5, 7, e2 and 9 are oriented to face the pressure side. Moreover, the position of the longitudinal axis L, which is illustrated in FIG. 1, through the end face St of the rib-like sealing structure, at the same time also corresponds to the radial center of gravity plane of the turbine rotor blade.

Figure 3:
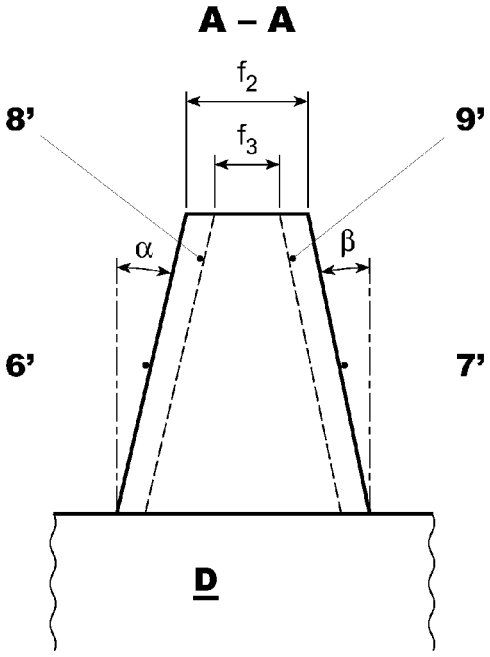
FIG. 3 illustrates a cross-sectional view along the plane A-A in FIG. 2.

Shown in FIG. 3 is a cross-sectional view along the plane A-A in FIG. 2. It can be gathered from FIG. 3 that the side flanks 6' and 7' in each case include an angle $\alpha$, $\beta$ with the orthogonals with regard to the shroud surface, the angle typically being within the range of between 0.1° and 45°. The same angle of inclination also applies to the side flanks 8' and 9'.

Figure 4:
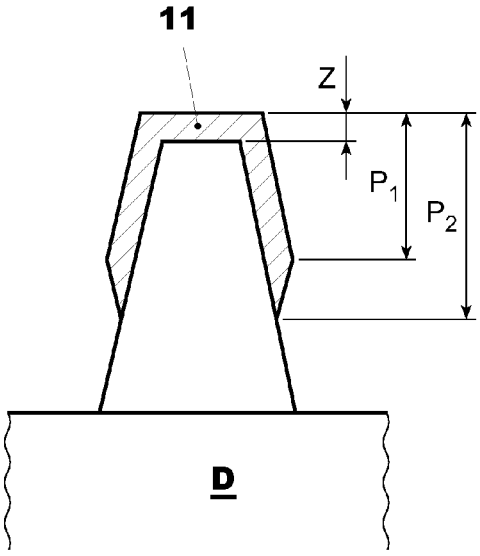
FIG. 4 illustrates a cross-sectional view through a cutting contour.

Shown in FIG. 4 is a cross-sectional view through a cutting contour. It is not necessarily required to provide the entire surface of the cutting contour with a surface-hardened coating 11. It is necessary to at least coat that surface region of the cutting contour with the surface-hardened coating 11 which engages with the abradable material on the turbine casing wall. For this purpose, it is advantageous to provide an effective coating thickness Z of 0.1 mm to 4.5 mm on the cutting surface, which at least has a penetration depth P1 with which the cutting contour is able to penetrate into the abradable material. The cutting depth P1 is typically about 0.5 mm to 15 mm. Over a wider region P2, which extends between P1+0.5 mm and 15 mm, the coating thins out.

LIST OF DESIGNATIONS

1 to 10 Side edges
e1, e2 Cutting edges
B1 Rear delimiting plane
B2 Front delimiting plane in direction of rotation
1', . . . 10' Side edge surfaces
e1', e2' Cutting edge surfaces
D Shroud
DS Sealing structure
f1, f2, f3 Axial width of the sealing structure
Z Coating thickness for a surface-hardened coating
11 Surface-hardened coating
P1, P2 Coating parameter While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A sealing device on a shroud of a turbine rotor blade tip, the sealing device including five surface sections extending along a longitudinal axis of the sealing device, comprising:

first and second side edges extending parallel to the longitudinal axis and delimiting a first surface section, and a rear third delimiting edge inclined relative to the longitudinal axis, wherein the first and second side edges have a mutual latitudinal spacing f1, the first side edge extending to a distance a1 and the second side edge extending to a distance a2, the distances a1 and a2 being measured from a first reference plane B1 which orthogonally intersects the longitudinal axis and delimits an end face at a rear end wherein the second side edge is spaced a distance from the first reference plane B1 and is connected to the first side edge via the rear third delimiting edge;

fourth and fifth side edges extending in an inclined manner relative to the longitudinal axis and delimiting a second surface section, the fourth side edge extending from an end of the first side edge to a distance b1, and the fifth side edge extending from the second side edge to a distance b2, both the distances b1 and b2 measured from the first reference plane B1;

sixth and seventh side edges extending parallel to the longitudinal axis and delimiting a third surface section, the sixth and seventh side edges having a mutual latitudinal spacing f2, the sixth side edge being connected to the fourth side edge and the seventh side edge being connected to the fifth side edge;

eighth and ninth side edges extending parallel to the longitudinal axis and delimiting a fifth surface section, and a front tenth delimiting edge inclined relative to the longitudinal axis, the eighth and ninth side edges having a mutual latitudinal spacing f3, the eighth side edge extending to a distance c1 and the ninth side edge extending to a distance c2, the distances c1 and c2 being measured from a second reference plane B2 which orthogonally intersects the longitudinal axis and delimits an end face at a front end, wherein the eighth side edge is spaced from the second reference plane and is connected to the ninth side edge via the front tenth delimiting edge; and eleventh and twelfth side edges each comprising a cutting edge e1, e2 and together delimiting a fourth surface section, the eleventh and twelfth side edges both extending in an inclined manner relative to the longitudinal axis, the eleventh cutting edge extending from a distance d1 to the distance c1, and the twelfth cutting edge extending from a distance d2 to the distance c2, the distances d1 and d2 being measured from the second reference plane, and the eleventh side edge is connected to the sixth side edge and the twelfth side edge is connected to the seventh side edge, wherein the cutting edges e1, e2 facing in the direction of rotation, serve as transition regions between the rib region, of narrower design in the axial extent, in the fifth surface section with the mutual latitudinal spacing f3, and the third surface section, of axially wider design, with the mutual latitudinal spacing f2, and wherein the first and second reference planes B1 and B2 are spaced apart a distance S, and S=45 mm to 200 mm, $A1<a2$ and $\frac{1}{16} S<(a1, a2)<\frac{1}{2} S$, $b1<b2$ and $\frac{1}{16} S<(b1, b2L<\frac{1}{2} S$, $c1<c2$ and $\frac{1}{16} S<(c1, c2)<\frac{1}{2} S$, $d1<d2$ and $\frac{1}{16} S <(d1, d2)<\frac{1}{2} S$, $f3<f1$ and $\frac{1}{62} S <(f1, f3)<\frac{1}{14} S$, and $\frac{1}{42} S<f2<\frac{1}{5} S$.

2. The device as claimed in claim 1, wherein at least the eleventh and twelfth side edges are coated with a surface-hardened coating and are configured and arranged as cutting structures.

3. The device as claimed in claim 1, wherein:

the first, second, sixth, and seventh side edges each are spaced from the longitudinal axis; and the longitudinal axis aligns with the eighth side edge.

4. The device as claimed in claim 1, comprising:

side flanks extending in an inclined manner relative to a flat end face, which is configured to radially face away from the turbine rotor blade, the inclinations of which side flanks each face each other, and wherein the side flanks each include radially upper edges which delimit the flat end face.

5. The device as claimed in claim 4, wherein the side flanks include flanks at the sixth and seventh side edges which are each inclined at an inclination angle of between 0.1° and 45° to orthogonals of the third surface section.

6. The device as claimed in claim 1, comprising:

a surface-hardened coating included to at least one of the surface sections.

7. The device as claimed in claim 6, wherein the surface-hardened coating has a coating thickness of up to 4.5 mm.

8. The device as claimed in claim 6, wherein the surface-hardened coating consists essentially of $Cr_2C$ or CBN.

9. A turbine blade shroud comprising:

a shroud plate having a radially outer surface; and at least one sealing device according to claim 1 on the radially outer surface.

10. The turbine blade shroud as claimed in claim 9, wherein a longitudinal length of the sealing device is a length of the shroud in a direction of rotation.

11. The turbine blade shroud as claimed in claim 9, wherein the at least one sealing device tapers with increasing radial distance from the shroud.

12. A turbine blade comprising:

an airfoil having a tip and a root end, wherein the root end is configured and arranged to be attached to a rotor; and a turbine blade shroud according to claim 9 attached to said airfoil tip.

13. A turbine blade according to claim 12, wherein:

the airfoil comprises a contour which defines a pressure side and a suction side of the blade.

14. A turbine blade according to claim 12, wherein:

the at least one sealing device is arranged as a line of ribs radially projecting over the shroud relative to a rotational axis around which the turbine rotor blade is rotatably arranged;

the at least one sealing device has a longitudinal length oriented in the direction of rotation of the turbine rotor blade;

the at least one sealing device tapers with increasing radial distance from the shroud and terminates at a flat end face which radially faces away from the turbine rotor blade.

15. The device as claimed in claim 1, wherein:

the distance a1 is less than the distance b1;

the distance a2 is less than the distance b2;

the distance c1 is less than the distance d1; and the distance c2 is less than the distance d2.

16. The device as claimed in claim 1, wherein the distance a1 extends from the first reference plane B1 to the end of the first side edge, the distance a2 extends from the first reference plane B1 to an end of the second side edge, and wherein the fifth side edge extends from the end of the second side edge, the distance c1 extends from the second reference plane B2 to an end of the eighth side edge, and the distance c2 extends from the second reference plane B2 to an end of the ninth side edge.

17. A sealing device on a shroud of a turbine rotor blade tip, the sealing device including five surface sections extending along a longitudinal axis of the sealing device, comprising:

first and second side edges extending parallel to the longitudinal axis and delimiting a first surface section, and a rear third delimiting edge inclined relative to the longitudinal axis, wherein the first and second side edges have a mutual latitudinal spacing f1, the first side edge extending to a distance a1 and the second side edge extending to a distance a2, the distances a1 and a2 being measured from a first reference plane B1 which orthogonally intersects the longitudinal axis and delimits an end face at a rear end wherein the second side edge is spaced a distance from the first reference plane B1 and is connected to the first side edge via the rear third delimiting edge;

fourth and fifth side edges extending in an inclined manner relative to the longitudinal axis and delimiting a second surface section, the fourth side edge extending from an end of the first side edge to a distance b1, and the fifth side edge extending from the second side edge to a distance b2, both the distances b1 and b2 measured from the first reference plane B1;

sixth and seventh side edges extending parallel to the longitudinal axis and delimiting a third surface section, the sixth and seventh side edges having a mutual latitudinal spacing f2, the sixth side edge being connected to the fourth side edge and the seventh side edge being connected to the fifth side edge;

eighth and ninth side edges extending parallel to the longitudinal axis and delimiting a fifth surface section, and a front tenth delimiting edge inclined relative to the longitudinal axis, the eighth and ninth side edges having a mutual latitudinal spacing f3, the eighth side edge extending to a distance c1 and the ninth side edge extending to a distance c2, the distances c1 and c2 being measured from a second reference plane B2 which orthogonally intersects the longitudinal axis and delimits an end face at a front end, wherein the eighth side edge is spaced from the second reference plane and is connected to the ninth side edge via the front tenth delimiting edge; and eleventh and twelfth side edges each comprising a cutting edge e1, e2 and together delimiting a fourth surface section, the eleventh and twelfth side edges both extending in an inclined manner relative to the longitudinal axis, the eleventh cutting edge extending from a distance d1 to the distance c1, and the twelfth cutting edge extending from a distance d2 to the distance c2, the distances d1 and d2 being measured from the second reference plane, and the eleventh side edge is connected to the sixth side edge and the twelfth side edge is connected to the seventh side edge, wherein the distance a1 is less than the distance b1, the distance a2 is less than the distance b2, the distance c1 is less than the distance d1, and the distance c2 is less than the distance d2, and wherein the cutting edges e1, e2 facing in the direction of rotation, serve as transition regions between the rib region, of narrower design in the axial extent, in the fifth surface section with the mutual latitudinal spacing f3, and the third surface section, of axially wider design, with the mutual latitudinal spacing f2, and wherein the first and second reference planes B1 and B2 are spaced apart a distance S, and S=45 mm to 200 mm, A1<a2 and $\frac{1}{16}$ S<(a1, a2)<$\frac{1}{2}$ S, b1<b2 and $\frac{1}{16}$ S<(b1, b2L<$\frac{1}{2}$ S, c1<c2 and $\frac{1}{16}$ S<(c1, c2)<$\frac{1}{2}$ S, d1<d2 and $\frac{1}{16}$ S <(d1, d2)<$\frac{1}{2}$ S, f3<f1 and $\frac{1}{62}$ S<(f1, f3)<$\frac{1}{14}$ S, and 1/42 S<f2<$\frac{1}{5}$ S.

18. The device as claimed in claim 17, wherein the distance a1 extends from the first reference plane B1 to the end of the first side edge, the distance a2 extends from the first reference plane B1 to an end of the second side edge, and wherein the fifth side edge extends from the end of the second side edge, the distance c1 extends from the second reference plane B2 to an end of the eighth side edge, and the distance c2 extends from the second reference plane B2 to an end of the ninth side edge.

* * * * *